US010422305B2

(12) United States Patent
Winter et al.

(10) Patent No.: US 10,422,305 B2
(45) Date of Patent: Sep. 24, 2019

(54) DEVICE AND METHOD FOR EXHAUST GAS RECIRCULATION

(71) Applicant: MOTORENFABRIK HATZ GMBH & CO. KG, Ruhstorf/Rott (DE)

(72) Inventors: Tobias Winter, Fürstenzell (DE); Simon Thierfelder, Vilshofen (DE); Erich Eder, Neuhaus/Inn (DE); Thomas Stieglbauer, Triftern (DE)

(73) Assignee: MOTORENFABRIK HATZ GMBH & CO. KG, Ruhstorf/Rott (DE)

( * ) Notice: Subject to any disclaimer, the term of this patent is extended or adjusted under 35 U.S.C. 154(b) by 0 days.

(21) Appl. No.: 15/806,882

(22) Filed: Nov. 8, 2017

(65) Prior Publication Data

US 2018/0066611 A1 Mar. 8, 2018

Related U.S. Application Data

(63) Continuation of application No. PCT/EP2016/060143, filed on May 6, 2016.

(30) Foreign Application Priority Data

May 9, 2015 (DE) ..... 10 2015 006 100

(51) Int. Cl.
*F02M 26/24* (2016.01)
*F02M 26/28* (2016.01)
(Continued)

(52) U.S. Cl.
CPC ..... *F02M 26/24* (2016.02); *F02M 26/28* (2016.02); *F02M 26/30* (2016.02); *F02M 26/32* (2016.02);
(Continued)

(58) Field of Classification Search
CPC ..... F02M 26/24; F02M 26/73; F02M 26/28; F02M 26/30; F02M 26/32; F01P 5/10; F01P 3/20
See application file for complete search history.

(56) References Cited

U.S. PATENT DOCUMENTS 5,690,082 A * 11/1997 Tanioka ..... F01P 3/20 123/41.28
5,769,390 A * 6/1998 Ando ..... F16K 31/046 251/129.05
(Continued)

FOREIGN PATENT DOCUMENTS

DE 10232515 A1 4/2004
DE 102010014845 A1 10/2011
(Continued)

OTHER PUBLICATIONS

International Search Report, dated Jul. 14, 2016, for corresponding International Application No. PCT/EP2016/060143.

*Primary Examiner* — Joseph J Dallo
(74) *Attorney, Agent, or Firm* — Myers Wolin, LLC

(57) ABSTRACT

A device is provided for exhaust gas recirculation (EGR), in particular in diesel engines, from the exhaust gas tract into the fresh air path of the engine, wherein a cooling device connected to the cooling system of the engine is provided within an EGR section as an exhaust-gas (EG)/coolant heat exchanger, with which an EGR valve for proportioning the EG recirculation rate is associated. The EGR valve is connected to a coolant, and the cooling device comprises an EG pre-cooler and an EG main cooler connected downstream of the EG pre-cooler. The EGR valve is installed between the EG pre-cooler and the EG main cooler in a valve housing between the EG pre-cooler and the EG main cooler. A method for EGR is provided as well.

14 Claims, 6 Drawing Sheets

(51) Int. Cl.

| | |
|---|---|
| ***F02M 26/30*** | (2016.01) |
| ***F02M 26/32*** | (2016.01) |
| ***F02M 26/73*** | (2016.01) |
| *F01P 3/20* | (2006.01) |
| *F01P 5/10* | (2006.01) |

(52) U.S. Cl.
CPC ..... *F02M 26/73* (2016.02); *F01P 3/20* (2013.01); *F01P 5/10* (2013.01)

(56) References Cited

U.S. PATENT DOCUMENTS 6,216,677 B1 * 4/2001 McConnell ..... F02M 26/54 123/568.12
9,638,141 B2 * 5/2017 Barabasch ..... F02M 26/73
2002/0174858 A1 * 11/2002 Kato ..... F02B 47/08 123/568.12
2004/0099245 A1 * 5/2004 Kato ..... F02M 26/22 123/434
2004/0107949 A1 * 6/2004 Miyoshi ..... F02M 26/57 123/568.12
2004/0177605 A1 * 9/2004 Kojima ..... F01N 3/0814 60/274
2006/0277906 A1 * 12/2006 Burk ..... F02B 29/0443 60/599
2007/0095334 A1 * 5/2007 Nanba ..... F02D 9/1045 123/568.24
2010/0263610 A1 * 10/2010 Mercz ..... F16K 1/222 123/41.09
2014/0007852 A1 * 1/2014 Huesges ..... F28F 3/048 123/568.12
2015/0047341 A1 * 2/2015 Ulrey ..... F02B 29/04 60/600
2015/0047346 A1 * 2/2015 Styles ..... F02B 47/08 60/605.2
2015/0059716 A1 * 3/2015 Na ..... F02M 26/24 123/568.12
2015/0267602 A1 * 9/2015 Amano ..... F01P 3/02 123/41.29

FOREIGN PATENT DOCUMENTS

DE 102011001461 A1 9/2012
EP 2378104 A1 10/2011

* cited by examiner

DEVICE AND METHOD FOR EXHAUST GAS RECIRCULATION

CROSS REFERENCE TO RELATED APPLICATIONS

This application is a continuation under 35 U.S.C. § 120 of International Application PCT/EP2016/060143, filed May 6, 2016, which claims priority to German Application 10 2015 006 100.3, filed May 9, 2015, the contents of each of which are incorporated by reference herein.

FIELD OF THE INVENTION

The invention relates to a device for exhaust-gas recirculation (EGR), in particular in diesel engines. It furthermore relates to a method for exhaust-gas recirculation (EGR), in particular in diesel engines.

BACKGROUND

Known embodiments of exhaust-gas recirculation (EGR) conduct an exhaust-gas train branched off from the engine, on the exhaust-gas side, for recirculation into the fresh-air path of the engine, within an EGR section. They comprise a cooling device connected with the cooling system of the engine as an exhaust-gas/coolant heat exchanger, as well as an EGR valve, the task of which consists in regulating the recirculated amount of exhaust gas with adaptation to the characteristic field data of the engine.

In this regard, reference is made to DE 10 2010 014 845 A1 as an example.

On the one hand, an important concern in connection with diesel engines is to utilize exhaust-gas recirculation (EGR) for NOx reduction. In this regard, exhaust gas that is as cold as possible is to be supplied to the engine on its fresh-air side, in order to keep the process temperature as low as possible for the stated purpose. For this reason, it is provided, according to a known embodiment, to dispose the EGR valve on the cold side of the heat exchanger, but this brings with it the disadvantage that the EGR valve tends to accumulate soot at operating points below the condensation point of the exhaust gas.

In the case of another known embodiment, the EGR valve is therefore disposed on the hot side of the heat exchanger, but this causes it to be subject to great thermal stress, and therefore it only achieves the limited useful lifetime that is similar to a component subject to wear.

In addition, cooler aging (fouling) of the heat exchanger caused by surface deposits is an additional problem, leading to deterioration of the heat transfer in the cooling section, and this has a disadvantageous effect on the method of action of the EGR section.

SUMMARY

In contrast, the present invention is based on the task of creating an improved device of the type stated initially, which avoids the stated disadvantages, in particular, it relieves thermal stress on the EGR valve in favor of a longer useful lifetime, and thereby meets the requirement of efficient EGR recirculation for robust and long-lived industrial diesel engines.

According to the invention, this goal is achieved with a device according to the claims and further embodiments, as well as with a method according to the claims and further embodiments.

Because of the fact that according to the proposal of the invention, the cooling device is divided into an EG pre-cooler and an EG main cooler that follows it, the possibility exists of disposing the EGR valve between the EG pre-cooler and EG main cooler, with a valve housing being provided there to accommodate the EGR valve.

In this regard, both cooling of the valve housing in which the EGR valve is accommodated and internal cooling of the EGR valve are unproblematic, in that a coolant connector to the EG pre-cooler is assigned with the EGR valve. In this manner, external cooling of the EGR valve, the electrical components of which can furthermore be connected with separate internal cooling, takes place by way of the cooled valve housing.

Furthermore, the EG pre-cooler can be supplied with coolant by way of the coolant connector of the valve housing.

The branched-off exhaust gas is first cooled off in the EG pre-cooler and, after passing through the EGR valve, in the EG main cooler, so that a mixed temperature that promotes NOx reduction is achieved on the fresh-air side of the engine. Because of the fact that the EG main cooler follows the EGR valve, there is no risk of soot accumulation in the EGR valve cause by low temperatures of the recirculated exhaust gas.

By means of the serial circuit of EG pre-cooler and EG main cooler according to the invention, the influence of disadvantageous cooler aging is furthermore counteracted, because a decrease in the cooling effect of the EG pre-cooler is compensated by the downstream EG main cooler. In the event of an increasing entry temperature difference on the side of the EG pre-cooler, a higher entry temperature difference on the side of the AG main cooler also occurs, which cooler thereby approximately compensates the decrease in cooling effect of the EG pre-cooler. In this way, the disadvantage fouling problem is eliminated by means of maintaining the mixed temperature on the fresh-air side of the engine, i.e. deposits in the EG cooling system do not lead to an increase in the exhaust-gas temperature after the EG main cooler, within certain limits, even if a certain deterioration of the heat transfer caused by cooler aging would have to be accepted in the EG pre-cooler.

Both the EG pre-cooler and the EG main cooler can advantageously be configured as cast parts, either in one-part form or multi-part form.

In this regard, it can be provided, according to the invention, that the EG pre-cooler and the valve housing are configured as a one-part component.

Production simplification results from the further variant that the EG pre-cooler and/or the EG main cooler each have a multi-part housing. This is connected with the advantageous possibility that a pre-fabricated heat-exchanger insert part can be installed into the cooler housing, in each instance, and that in this manner, the EG pre-cooler and the EG main cooler can be equipped with the same heat-exchanger insert parts. Preferably, commercially available pipe-bundle heat exchangers can be used as heat-exchanger insert parts for the exhaust gas.

In this connection, the variant that a housing part of the pre-cooler and/or of the main cooler that connects with the valve housing is configured in one piece, in each instance, with the valve housing can be advantageous; in this way, it is possible to eliminate two separate components, and sealing flanges with screw connection parts are not required.

In a first embodiment variant, the engine cooling water for the EGR system is withdrawn from the engine cooling-water circuit, and it is advantageous if it is first conducted to the valve housing. In this housing, it is divided into multiple cooling-water paths. One of these runs through the EG pre-cooler and afterward through the EG main cooler; a further path flows through the valve housing and cools the EGR valve from the outside when doing so, and is afterward conducted to the engine cooling system; a further cooling-water path flows through the interior of the EGR valve, where it cools the electrical components of the valve.

Ultimately, all the cooling-water paths flow into the engine cooling water of the engine again, by way of hose lines. A partial stream can be conducted by way of the oil cooler, for example, and then flow back to the engine cooler.

Aside from the known pipe-bundle heat-exchanger elements, heat exchangers with case chambers are fundamentally also suitable for conducting the exhaust-gas stream, with the cooling water flowing around the chambers on the outside. In this regard, improvement of the heat transfer can be achieved, in simple manner, in that the inner cast surfaces of the heat exchangers are configured to be relatively rough on one or both sides, so that flow turbulences occur both on the gas side and on the water side.

In a further embodiment variant, a first cooling-water path is conducted into the EG pre-cooler and gets into the EG main cooler directly from there; here, the valve housing is supplied by means of a separate cooling-water path for the housing cooling and the interior cooling of the EGR valve.

To implement the above embodiment variants, it is proposed, according to the invention, that a coolant connector forms the coolant inflow to the valve housing, that the EG pre-cooler is connected with the valve housing and provided with a coolant drain to the EG main cooler.

Furthermore, it is proposed that the valve housing is provided with further coolant drains to the engine cooling system and/or other heat exchangers on the engine side.

Finally, it is proposed that the EG pre-cooler has separate cooling channels for conducting the coolant, which extend in the longitudinal direction of the EG pre-cooler, for cooling the exhaust gas in a counter-stream.

According to a further embodiment, it is provided that a coolant connector forms the coolant inflow to the EG pre-cooler, the coolant drain of which is directly connected with the EG main cooler, the coolant drain of which, in turn, is connected with the engine cooling system.

According to a method for exhaust-gas recirculation that is particularly advantageous in the case of diesel engines, it is provided that the exhaust gas branched off from the exhaust-gas train of the engine is sent in series, within an EGR section, first through an EG pre-cooler, then through an EGR valve for proportioning the EG recirculation rate and its distribution, and finally through an EG main cooler.

The coolant is branched off, in each instance, from the cooling system of the engine; the cooling water that is branched off in this process is conducted, in series, first through the EG pre-cooler, afterward through the EG main cooler. At least one partial amount of the branched-off cooling water is conducted through a valve housing that accommodates the EGR valve and/or through the interior of the EGR valve, and, if applicable, branched off to engine-side heat exchangers that are present outside of the EGR section.

The cooling water conducted through the EG pre-cooler is cooled there to a temperature clearly above the condensation point of the exhaust gas. The exhaust gas therefore gets through the EGR valve without putting excess thermal stress on it or endangering it due to condensation. In this regard, the exhaust gas branched off from the exhaust-gas manifold of the engine at 550 to 600° C. is cooled down by approximately 200 to 250° C. in the EG pre-cooler. The exhaust gas cooled off in the EG main cooler leaves the EGR section at an exit temperature of not more than about 100° C.

The EGR valve is relieved of thermal stress by means of the serial circuit, according to the invention, of EG pre-cooler and EG main cooler, and the placement of the EGR valve between the two coolers, on the one hand; on the other hand, the exhaust-gas temperature in the EGR valve is still clearly above the condensation temperature of the exhaust gas, so that soot accumulation does not occur in the EGR valve, something that is observed in known EGR sections with EGR valves disposed in the entry.

BRIEF DESCRIPTION OF THE DRAWING

In the following, exemplary embodiments of the invention will be explained using the drawing. This shows.

DETAILED DESCRIPTION OF THE PREFERRED EMBODIMENTS

Figure 1:
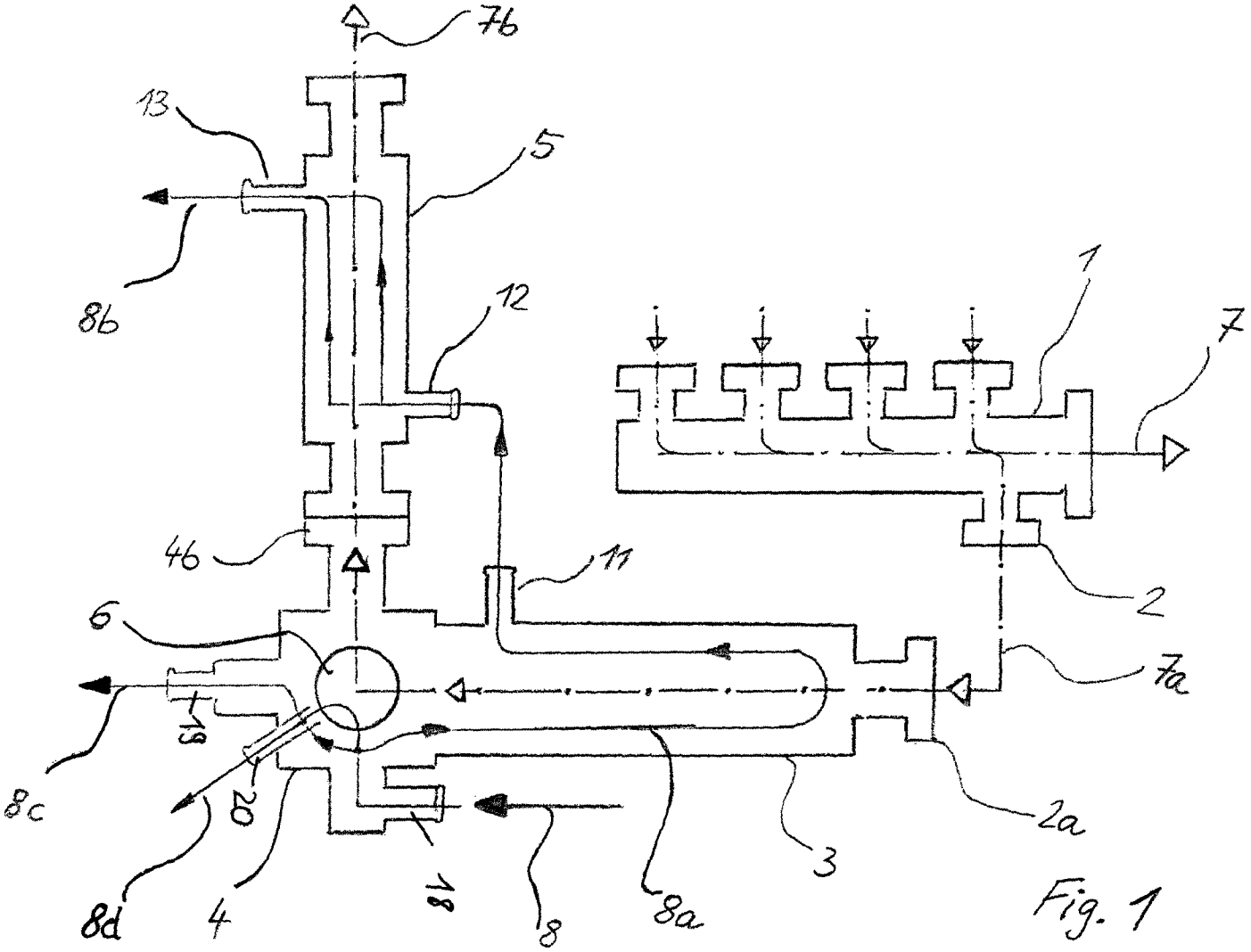
FIG. 1 shows, in a schematic representation, an EGR section with an EG pre-cooler and an EG main cooler, each configured in one piece.

FIG. 1, in a schematic representation, shows an EGR section following an exhaust-gas manifold, from which the engine exhaust gas 7 is conducted to the outside by way of the exhaust-gas system (not shown). The exhaust-gas manifold 1 possesses a branch 2, by way of which a partial exhaust gas stream 7*a* is conducted to an EG pre-cooler 3, afterward deflected by 90° in an EGR valve housing 4, and conducted to the intake manifold (not shown) of the engine by way of a downstream EG main cooler 5, as a cooled-down partial exhaust gas stream 7*b*.

The EG pre-cooler 3 is configured as a single-part cast part, together with the EGR valve housing 4, and connected with the EG main cooler 5, which is also configured as a cast part, by way of a flange connected 4*b*, forming a seal. The EG main cooler 5 is also configured in one piece; it ends with a flange 5*b* for connecting with the intake manifold of the engine, not shown.

Different cooling paths, which are all supplied by the cooling system of the engine, are shown with dark arrows, wherein the starting temperature of the engine oil cooler (not shown) approximately corresponds to the input temperature of the different cooling paths.

According to FIG. 1, a first cooling path 8 gets into the interior of the valve housing 4 by way of a coolant connector 18. There, division of the cooling path 8 comes about, into a first cooling path 8*a*, which runs through the pre-cooler 3 and by way of the coolant exit 11, the output of which is passed on to the EG main cooler 5. The cooling water that has been heated in the pre-cooler 3 gets back, by way of the coolant exit 13 of the latter, into the cooling system of the engine through the coolant entry 12 of the EG main cooler 5, according to the arrow 8*b*.

The branched-off exhaust gas stream 7*a*, the input temperature of which, into the pre-cooler 3, amounts to approximately 550 to 600° C., is cooled down by approximately 250 to 300° C. in the EG pre-cooler 3, and then exits from the EG main cooler 5 as an exhaust gas stream 7*b* having a temperature≤100° C., before it is conducted to the intake manifold of the engine.

In the interior of the EGR valve housing 4, a partial stream 8*c*, which serves for cooling the valve housing 4, is branched off from the cooling path 8. In the interior of the housing, there is a cooling mantle 22 (cf. FIG. 3) for cooling a seat bracket 23 for accommodating a valve body of the EGR valve 6. The partial cooling water stream 8*c* is conducted back into the cooling system of the engine by means of a coolant exit 19.

Furthermore, a further partial stream 8*d* is branched off in the interior of the valve housing 4, which stream flows through the interior of the EGR valve 6 for the purpose of cooling the electrical installed parts present there, and is connected with the cooling system of the engine by way of a coolant exit 20.

Figure 2:
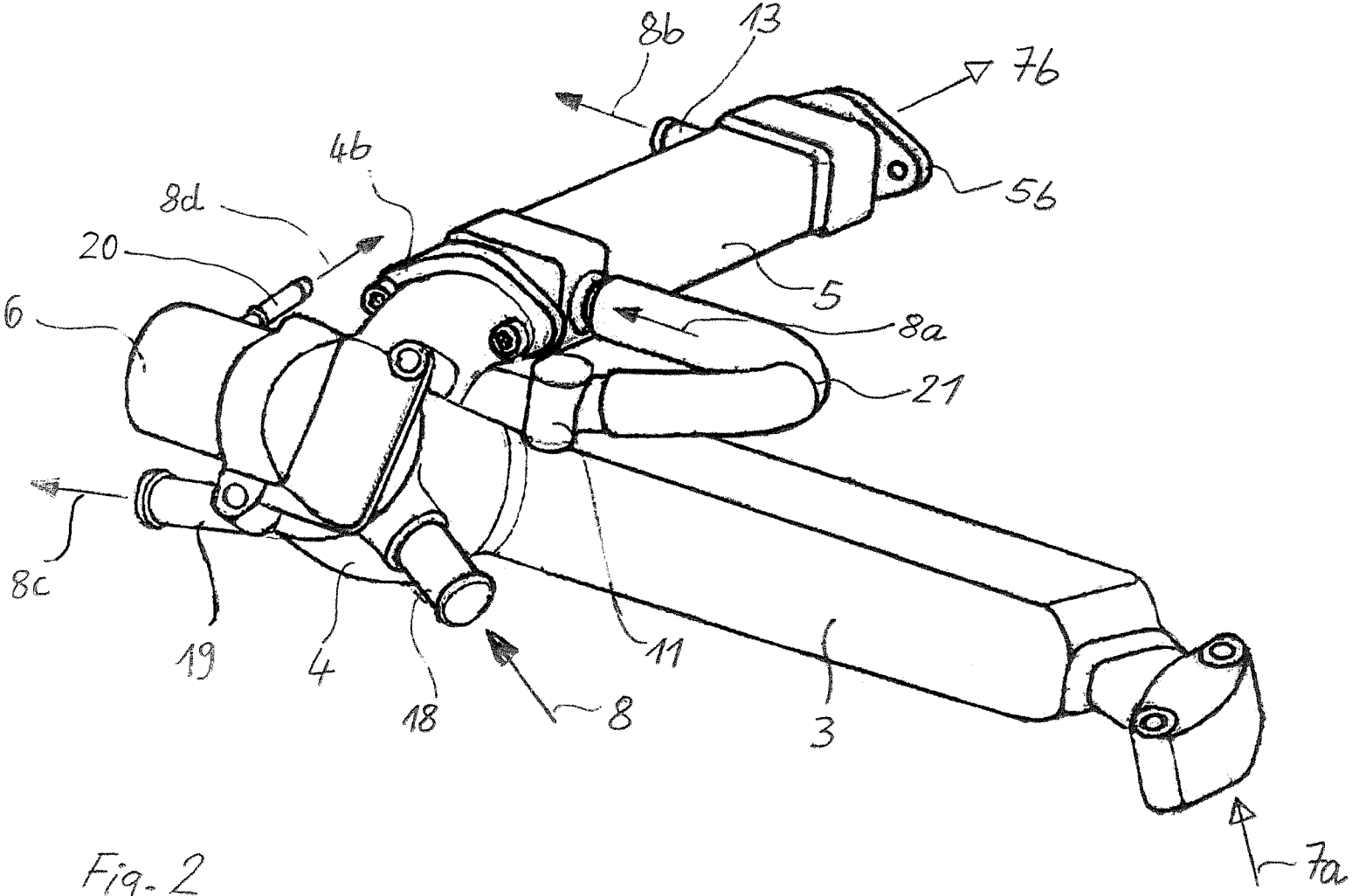
FIG. 2 shows a spatial representation of an embodiment according to FIG. 1, in a perspective, outside view.

FIG. 2, in a simplified spatial representation, shows an embodiment according to the principle of FIG. 1. There, the same components are identified with the reference symbols according to FIG. 1. In addition, a hose connection 21 is shown between the EG pre-cooler 3 and the EG main cooler 5. The two EG coolers 3, 5 follow one another at an angle of 90 degrees, as is evident in FIG. 1, wherein the angled piece is formed by the valve housing 4. The EG pre-cooler 3 is connected in one piece with the valve housing 4 that forms the angled piece, and it is advantageous if it is configured as a one-part cast piece.

Figure 3:
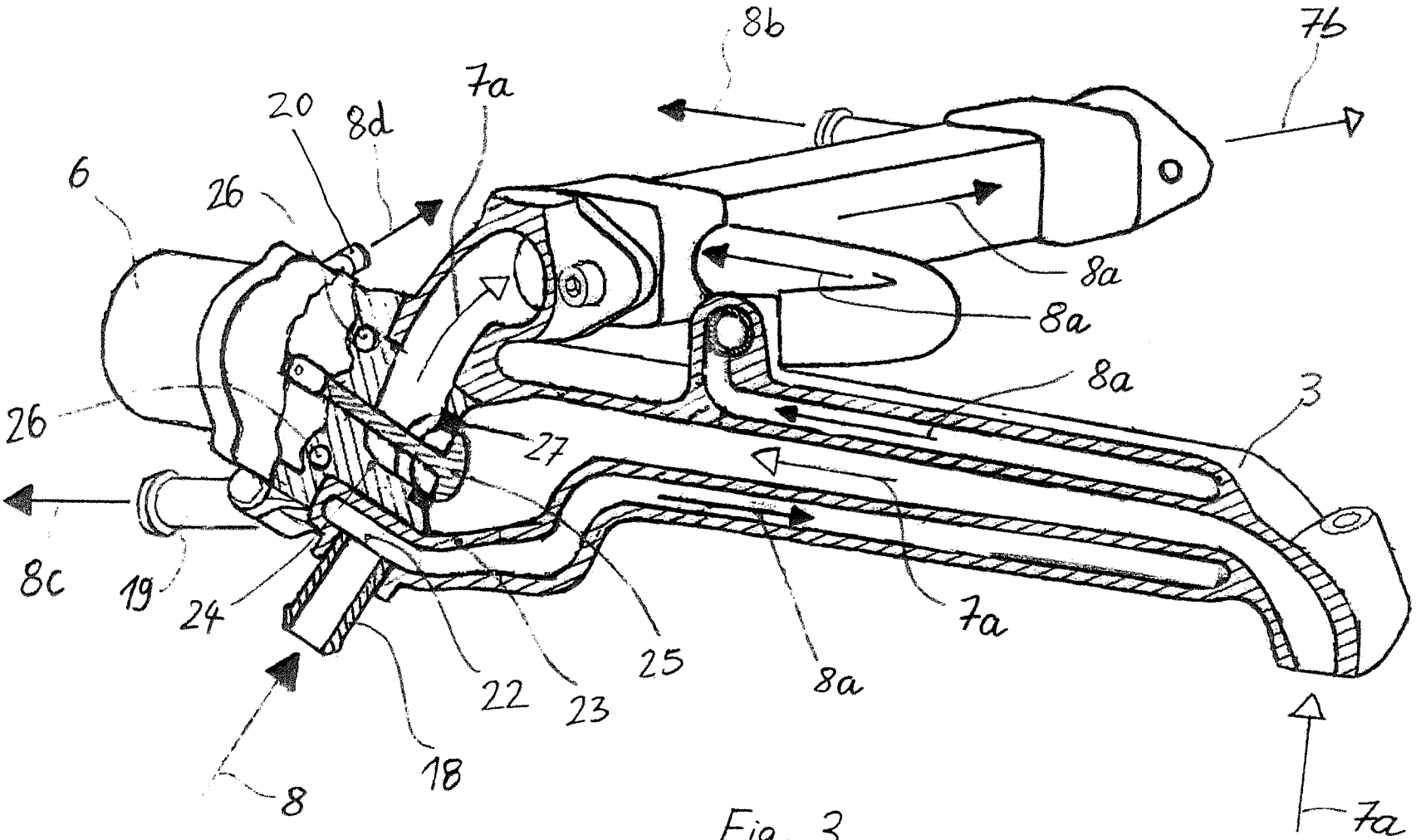
FIG. 3 shows the embodiment of FIG. 2, partly in section.

FIG. 3 shows further details relating to FIG. 2, namely the cooling mantle 22 of the valve housing 4, which has already been mentioned and serves to cool the seat bracket 23, in which the valve body 24 of the EGR valve 6 is accommodated.

The coolant is connected with the interior of the EGR valve 6 for the purpose of cooling the electrical installations accommodated there, by way of bores 26 in the valve body 24. These installations serve for activation of a valve tappet 25, which is shown in its closed position relative to a valve seat 27 in FIG. 3, and regulates the gas stream 7*a* as a function of the passage opening.

Figure 4:
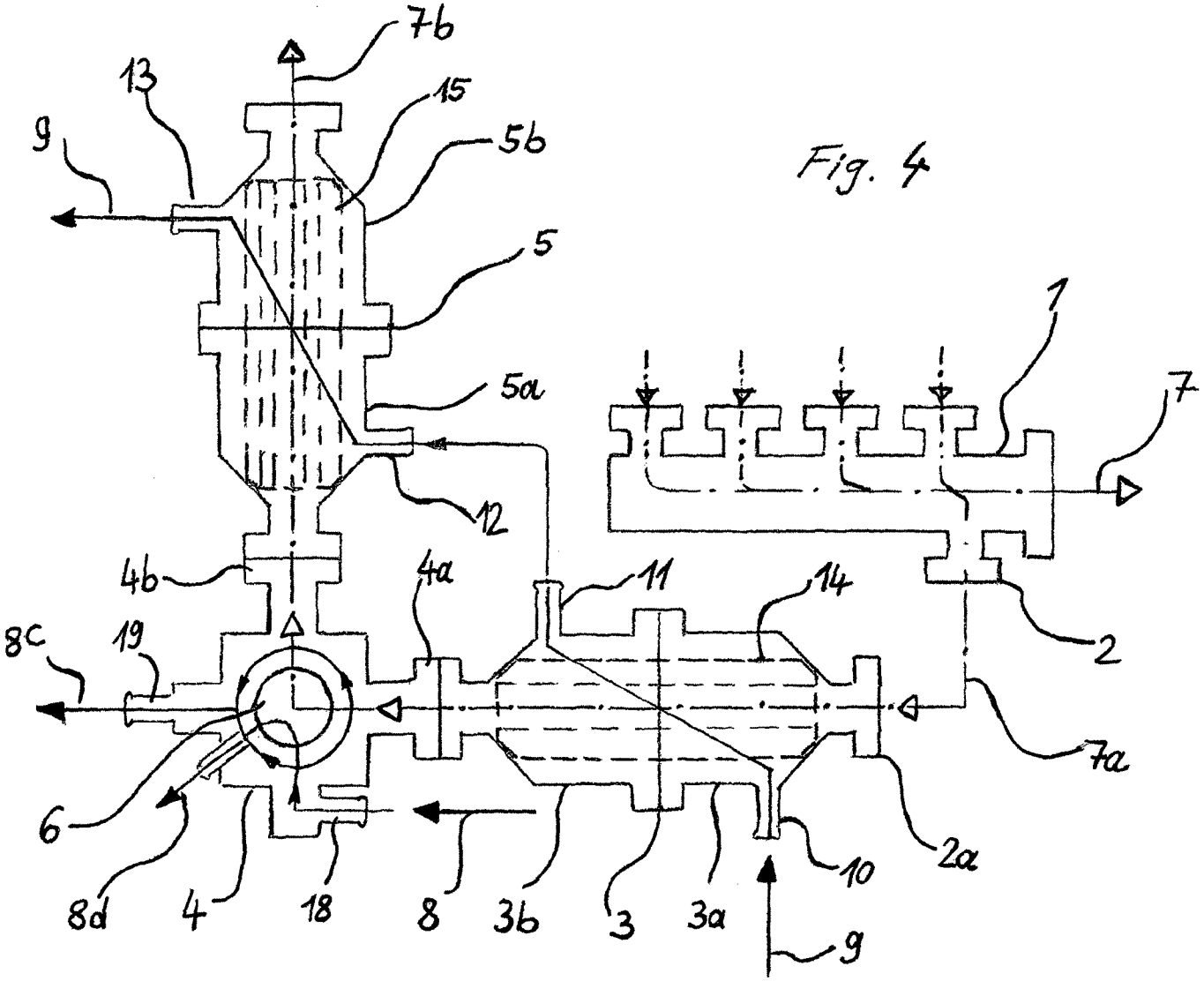
FIG. 4 shows a schematic representation of an EGR section, with an EG pre-cooler and an EG main cooler, each configured in divided form.

FIG. 4, in a schematic top view, shows an embodiment with a divided structure of the EG pre-cooler 3, of the EG main cooler 5, as well as a separate structure of the valve housing 4. Aside from the divided structure of the EG pre-cooler 3, in two housing halves 3*a* and 3*b*, as well as of the EG main cooler 5, in two housing halves 5*a* and 5*b*, FIG. 4 differs from FIG. 1 by a direct connection of a coolant path 9 branched off from the engine cooling system, to a coolant connector 10 of the housing part 3*a* of the EG pre-cooler 3. The coolant path 9 flows through the EG pre-cooler 3 and in this regard cools a heat-exchanger insert 14, which consists, for example, of a pre-fabricated pipe system for passing the partial exhaust gas stream 7*a* through. The EG main cooler is equipped with a similar pipe system 15, through which the partial exhaust gas stream 7*a* flows and exits from the EG main cooler 5 as a partial exhaust gas stream 7*b*, to be passed on into the fresh-air manifold of the engine. Furthermore, components shown in FIG. 4, which are the same as in FIG. 1, are provided with the same reference symbols. This also holds true for the spatial representation according to FIG. 5, which corresponds to the embodiment according to FIG. 4.

Figure 5:
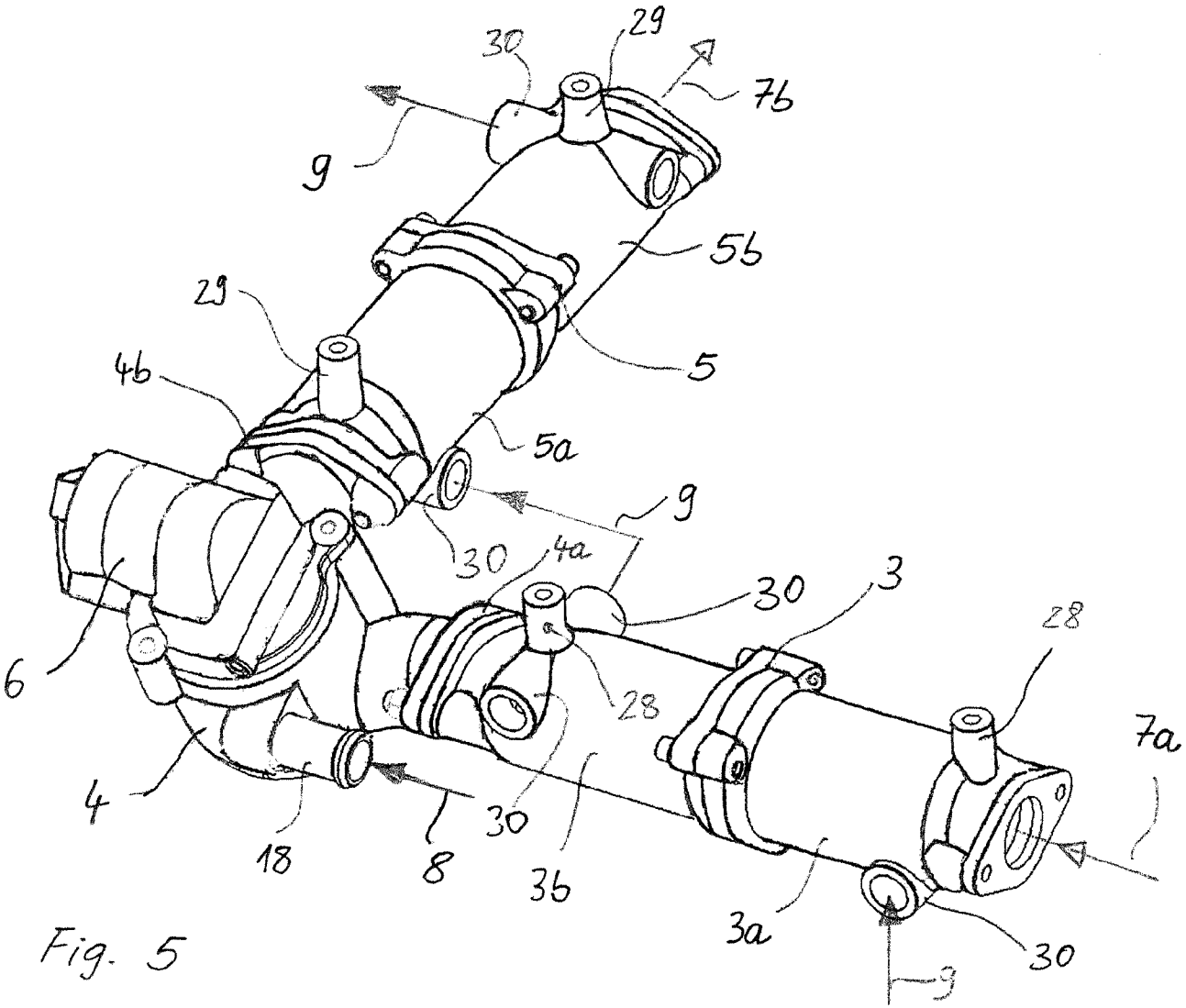
FIG. 5 shows a spatial representation of an embodiment according to FIG. 4, in a perspective outside view.

FIG. 5, in a simplified form, shows a spatial representation of the embodiment according to FIG. 4. There, the same components are identified with the reference numerals according to FIG. 4. In addition, sprue eyes 30 are shown, which are provided either as a connector for a hose connection or are provided with a closure lid. Cast-on attachment eyes 28, 29 are provided as attachment points for further components.

Figure 6:
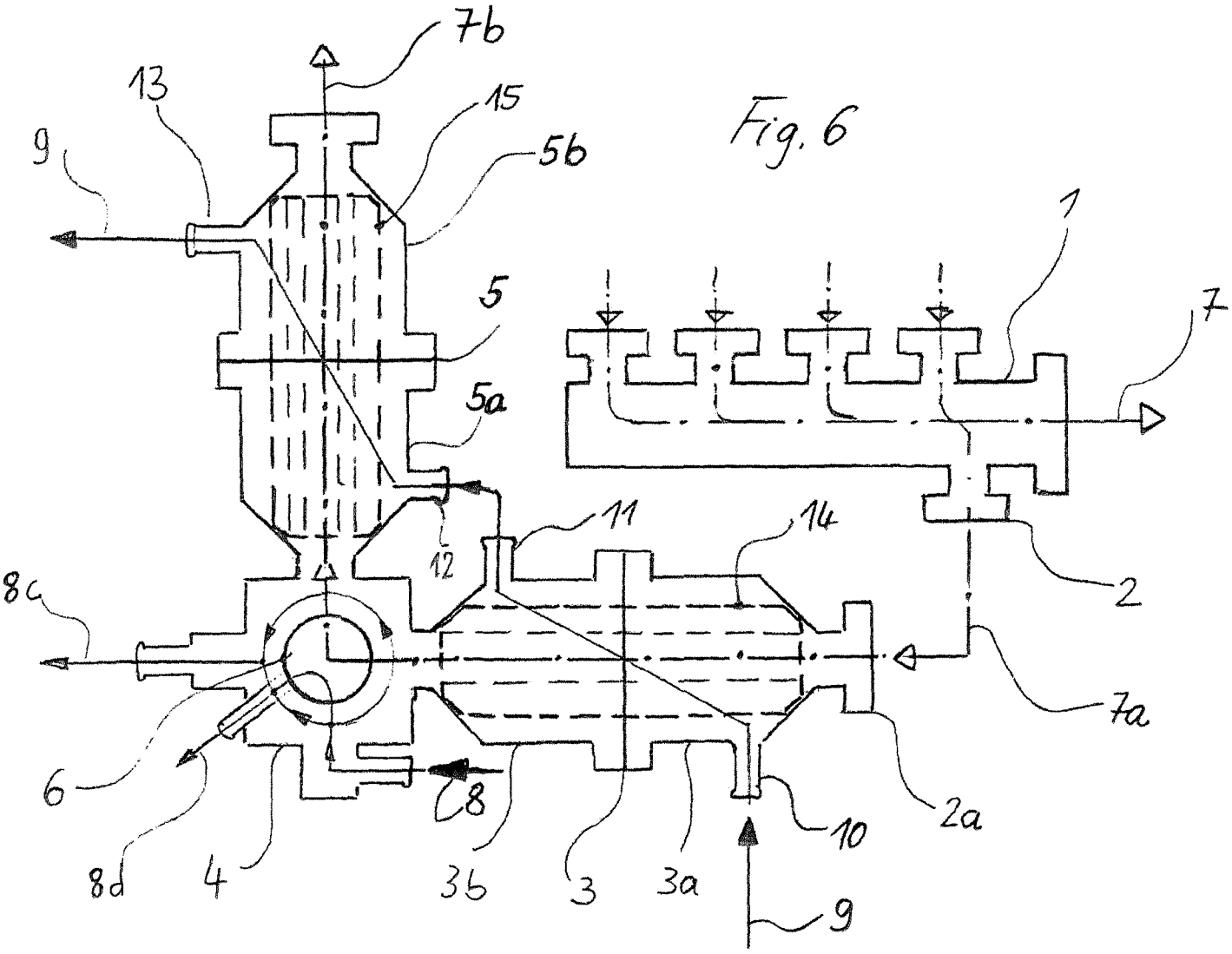
FIG. 6 shows, in a schematic representation, an embodiment variant of FIG. 4.

FIG. 6 shows a variant of FIG. 4, wherein the housing parts 3*b* and 5*a* are cast in one piece with the EGR valve housing 4 for cost reasons, thereby eliminating two individual cast parts and two flange seals.

What is claimed is:

1. A device for exhaust-gas recirculation (EGR) from the exhaust-gas train into the fresh-air path of the engine, wherein a cooling device connected to the cooling system of the engine is provided within an EGR section as an exhaust-gas (EG)/coolant heat exchanger, with which an EGR valve (6) for proportioning the EG recirculation rate is associated, wherein:

the cooling device comprises an EG pre-cooler (3) and an EG main cooler (5) that follows it spatially, wherein the EGR valve (6) is installed in a valve housing (4) disposed between the EG pre-cooler and the EG main cooler, wherein the valve housing (4) is connected with a separate cooling path (8*c*) for external cooling of the EGR valve (6) and wherein a further cooling path (8*d*) is provided for cooling electrical components in the interior of the EGR valve.

2. The device of claim 1, wherein the EG pre-cooler (3) and the valve housing (4) are configured as a one-part component.

3. The device of claim 1, wherein the EG pre-cooler (3) and/or the EG main cooler (5) each have a multi-part housing (3*a*, 3*b*; 5*a*, 5*b*).

4. The device of claim 3, wherein a housing part (3*b*; 5*a*) of the pre-cooler (3) and/or of the main cooler (5) that follows the valve housing (4), in each instance, is configured in one piece with the valve housing (4).

5. The device of claim 4, wherein a heat exchanger insert part in the manner of an EG pipe bundle (14, 15) is installed in the housings (3*a*, 3*b*; 5*a*, 5*b*), in each instance.

6. The device of claim 1, wherein a coolant connector (18) forms the coolant inflow to the valve housing (4), that the EG pre-cooler (3) is connected with the valve housing (4) and provided with a coolant drain (11) to the EG main cooler (5).

7. The device of claim 6, wherein the valve housing (4) is provided with further coolant drains (19) to the engine cooling system and/or other heat exchangers on the engine side.

8. The device of claim 7, wherein the EG pre-cooler (3) has separate cooling channels for EG cooling, for conducting the coolant, which channels extend in the longitudinal direction of the EG pre-cooler (3).

9. The device according of claim 1, wherein a coolant connector (10) forms the coolant inflow to the EG pre-cooler (3), the coolant drain (11) of which connector is directly connected with the EG main cooler (5), the coolant drain (13) of which, in turn, is connected with the engine cooling system.

10. A method for exhaust-gas recirculation (EGR), wherein:

the exhaust gas (EG) branched off from the exhaust-gas train of the engine, within an EGR section, is sent, in series, first through an EG pre-cooler (3), then, for proportioning of the EG recirculation rate and its distribution, through an EGR valve (6), and finally through an EG main cooler (5), wherein the EG main cooler follows the EG pre-cooler spatially, the cooling water branched off from the cooling system of the engine, as a coolant, is first conducted in series through the EG pre-cooler (3), afterward through the EG main cooler (5), and at least one partial amount of the branched-off cooling water is conducted for external cooling of the EGR valve (6) through a valve housing (4) that accommodates the EGR valve (6) and that is disposed between the EG pre-cooler and the EG main cooler and additionally through the interior of the EGR valve (6).

11. The method of claim 10, wherein the branched-off partial amount of the cooling water is branched off to heat exchangers on the engine side, which are present outside of the EGR section.

12. The method of claim 10, wherein the exhaust gas is branched off from the exhaust-gas manifold (1) of the engine and cooled by about 250 to 300° C. in the EG pre-cooler (3).

13. The method of claim 12, wherein the exhaust gas is cooled to an exit temperature <100° C. in the EGR section.

14. The method of claim 10, wherein cooling water branched off from the cooling system of the engine is withdrawn on the pressure side, behind the cooling-water pump of the engine.

* * * * *